US008644723B2

(12) United States Patent
Shibuya et al.

(10) Patent No.: US 8,644,723 B2
(45) Date of Patent: Feb. 4, 2014

(54) IMAGE FORMING APPARATUS

(75) Inventors: Satoru Shibuya, Chiryu (JP); Hidetoshi Noguchi, Tahara (JP); Kazuyoshi Hara, Itami (JP); Takahiro Kuroda, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 192 days.

(21) Appl. No.: 13/357,326

(22) Filed: Jan. 24, 2012

(65) Prior Publication Data

US 2012/0195617 A1 Aug. 2, 2012

(30) Foreign Application Priority Data

Feb. 2, 2011 (JP) ..... 2011-020616

(51) Int. Cl.
*G03G 15/00* (2006.01)

(52) U.S. Cl.
USPC ..... 399/71; 399/94; 399/101

(58) Field of Classification Search
USPC ..... 399/71, 34, 94–96, 101
See application file for complete search history.

(56) References Cited

U.S. PATENT DOCUMENTS

| | | | | |
|---|---|---|---|---|
| 7,764,889 | B2 * | 7/2010 | Hamaya et al. | 399/44 |
| 2008/0145081 | A1 * | 6/2008 | Woo et al. | 399/66 |
| 2012/0008967 | A1 * | 1/2012 | Shibuya et al. | 399/44 |

FOREIGN PATENT DOCUMENTS

| | | | |
|---|---|---|---|
| JP | 2001-296755 | A | 10/2001 |
| JP | 2005-031503 | A | 2/2005 |

* cited by examiner

*Primary Examiner* — David Gray
*Assistant Examiner* — Carla Therrien
(74) *Attorney, Agent, or Firm* — Buchanan Ingersoll & Rooney PC

(57) ABSTRACT

An image forming apparatus is for transferring a toner image on an image carrier onto a transfer medium, and thermally fixing the toner image by a fixing device, and comprises a cleaner removing residual toner on the image carrier. The apparatus: acquires information relating to a distribution of a density of the residual toner at each position within a section on the image carrier at an end of an image forming job, the section extending from the transfer position to immediately before a cleaning position; determines, based on the information, whether or not the density of the residual toner at the transfer position exceeds a corresponding threshold density pertaining to occurrence of fusion of the residual toner; and causes, if determining negatively, the drive unit to stop when the image forming job is completed and the residual toner at the transfer position reaches a predetermined position within the section.

5 Claims, 8 Drawing Sheets

IMAGE FORMING APPARATUS

This application is based on application No. 2011-20616 filed in Japan, the contents of which are hereby incorporated by reference.

BACKGROUND OF THE INVENTION (1) Field of the Invention

The present invention relates to an image forming apparatus including a fixing device, such as a printer or a copier, and in particular to a technology for preventing residual toner remaining after transfer from being fused onto an image carrier by heat generated from the fixing device.

(2) Description of the Related Art

An image forming apparatus, such as a printer or a copier, forms an electrostatic latent image on a photoreceptor (e.g., photosensitive drum), and thereafter forms a toner image by attaching toner onto the electrostatic latent image. Then, the image forming apparatus either directly transfers the toner image onto a recording sheet or, alternatively, primary-transfers the toner image onto an intermediate transfer member (e.g., intermediate transfer belt) and thereafter secondary-transfers the toner image onto a recording sheet.

Meanwhile, even after the toner image is transferred, a part of toner remains on the photoreceptor and the intermediate transfer member. Hereinafter, the part of toner remaining as such is simply referred to as "residual toner". If the residual toner is left uncleaned, the residual toner is melted by heat generated from a fixing device, and is fused onto the surfaces of the photoreceptor and the intermediate transfer belt. If the toner thus fused remains on parts of the photoreceptor and the intermediate transfer member, a newly-formed toner image does not adhere to the parts, causing problems like defective imaging or poor imaging.

Accordingly, a cleaning blade for removing the residual toner is provided on a rotation path of an image carrier such as a photoreceptor or an intermediate transfer member, so that the residual toner on the image carrier is removed by the cleaning blade each time an image forming job is completed.

Also, in order to prevent toner from being fused onto the surface of an intermediate transfer member (i.e., intermediate transfer belt) by heat generated from a fixing device, the following two technologies are known, for example. According to one of the technologies, a cooling fan is provided inside an intermediate transfer member so as to cool the intermediate transfer member (see Japanese Patent Application Publication No. 2005-31503). Also, according to the other technology, the following structure is employed so as to cool the intermediate transfer member. Specifically, an exhaust fan and a cooling fan are provided inside an apparatus. Also, roller members, with which an intermediate transfer member is suspended under tension, are made of heat pipes (Japanese Patent Application Publication No. 2001-296755).

With the aforementioned conventional technologies, it is possible to suppress a rise in the temperature of an intermediate transfer member caused by heat generated from a fixing device, and thereby to effectively prevent the residual toner from being fused onto the intermediate transfer member.

However, according to the conventional technologies, it is necessary to move residual toner to a position at which the residual toner can be removed by a cleaning blade. As a result, an image carrier needs to be rotated for a predetermined time period even after an image forming job is completed. This accelerates abrasion of the image carrier caused by contact with the cleaning blade, thus shortening life of the image carrier.

Also, in the case of cooling an image carrier with a cooling fan and an exhaust fan, the drive of the fans creates noise, and power consumption is increased.

SUMMARY OF THE INVENTION

The present invention has been achieved in view of the above problems, and an aim thereof is to provide an image forming apparatus capable of preventing residual toner from being fused onto an image carrier by heat generated from a fixing device, improving the life of the image carrier, and suppressing power consumption.

In order to solve the above problems, one aspect of the present invention is an image forming apparatus for transferring, at a transfer position, a toner image on an image carrier rotated by a drive unit onto a transfer medium, and thereafter thermally fixing the toner image to the transfer medium by a fixing device, the image forming apparatus comprising: a cleaner provided at a cleaning position on a rotation path of the image carrier, and configured to remove residual toner remaining on the image carrier; an acquisition unit configured to acquire distribution information, the distribution information relating to a distribution of a density of the residual toner remaining at each position within a section on the image carrier at an end of an image forming job, the section extending from the transfer position to immediately before the cleaning position; a determination unit configured to determine, based on the distribution information, whether or not the density of the residual toner remaining at least at the transfer position at the end of the image forming job exceeds a corresponding threshold density pertaining to occurrence of fusion of the residual toner; and a controller configured, if the determination unit determines negatively, to cause the drive unit to stop when the image forming job is completed and the residual toner remaining at the transfer position reaches a predetermined position within the section and, if the determination unit determines affirmatively, to cause the drive unit to stop when the image forming job is completed and the residual toner remaining at the transfer position reaches the cleaning position and is removed by the cleaner.

The predetermined position may be a position at which, when the residual toner remaining at the transfer position reaches the position, the density of the residual toner remaining at each position on the image carrier within the section becomes equal to or below the corresponding threshold density.

Also, within the section, the threshold density may be set to increase with increasing distance from the fixing device, and the determination by the determination unit is made by comparing the density of the residual toner remaining at each position on the image carrier within the section to the corresponding threshold density.

The distribution information may indicate a distribution of a density of a toner image at each position on the image carrier within the section, the toner image corresponding to the residual toner at each position on the image carrier within the section, and the determination unit may include a calculation unit configured to calculate the density of the residual toner at each position on the image carrier within the section, based on the distribution information. Furthermore, the image carrier may be an intermediate transfer belt.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings.

DESCRIPTION OF THE PREFERRED EMBODIMENTS

The following describes an embodiment of an image forming apparatus according to the present invention, by taking the example of a tandem-type color digital printer (hereinafter, simply referred to as "printer").

[1] STRUCTURE OF PRINTER

Figure 1:
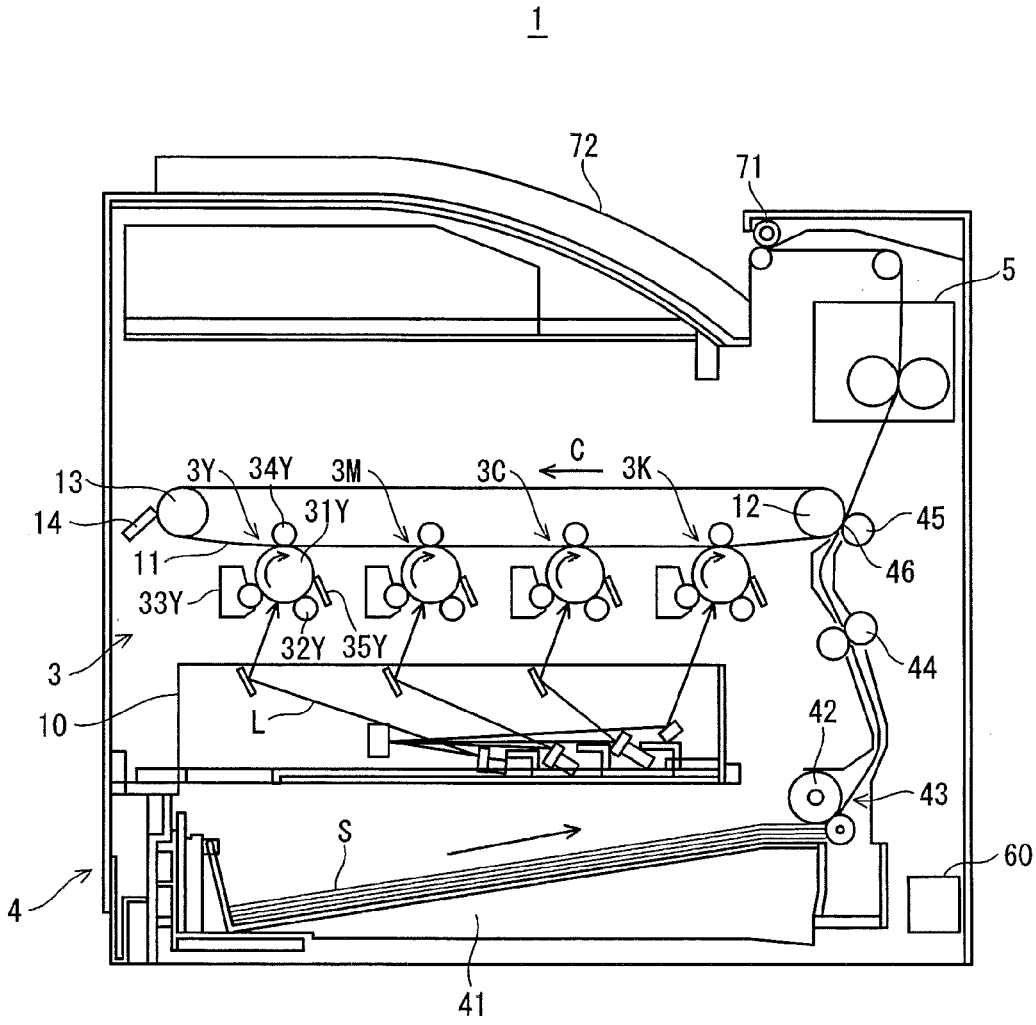
FIG. 1 shows the structure of a printer 1.

First, a description is provided of the structure of a printer 1 according to the present embodiment. FIG. 1 shows the structure of the printer 1 according to the present embodiment. As shown in FIG. 1, the printer 1 includes an image processor 3, a paper feeder 4, a fixing device 5, and a controller 60.

The printer 1 is connected to a network (e.g., LAN). Upon receiving a print instruction from an external terminal device (not shown) or an operation panel (not shown), the printer 1 performs printing processing by forming the toner images of yellow, magenta, cyan, and black based on the instruction, forming a full color image by multi-transferring the toner images, and printing the full color image onto a recording sheet.

Hereinafter, the reproduction colors of yellow, magenta, cyan, and black are respectively denoted by Y, M, C, and K. The components pertaining to the reproduction colors are indicated by reference signs with Y, M, C, and K.

The image processor 3 includes: imaging units 3Y, 3M, 3C, and 3K; an exposure unit 10; an intermediate transfer belt 11; a secondary transfer roller 45; and so on. Since the imaging units 3Y, 3M, 3C, and 3K have the same structure, the following mainly describes the structure of the imaging unit 3Y.

The imaging unit 3Y includes: a photosensitive drum 31Y; a charger 32Y; a developer 33Y; a primary transfer roller 34Y; and a cleaning blade 35Y, and forms a Y-color toner image on the photosensitive drum 31Y. The charger 32Y, the developer 33Y, and the primary transfer roller 34Y are provided around the photosensitive drum 31Y. The cleaning blade 35Y is in contact with the photosensitive drum 31Y, and cleans and removes residual toner on the photosensitive drum 31Y after a toner image is primary-transferred onto the intermediate transfer belt 11. The developer 33Y faces the photosensitive drum 31Y, and conveys charged toner to the photosensitive drum 31Y.

The intermediate transfer belt 11 is an endless belt that is wound around and suspended under tension over a driving roller 12 and a driven roller 13, and is driven to rotate in a direction of the arrow C. The controller 60 controls the rotation of the intermediate transfer belt 11 by controlling the drive of a drive motor, which is a motor for rotating the driving roller 12 (see a drive motor 30 in FIG. 2, which is described below). When an image forming job is completed, the controller 60 performs control such that the intermediate transfer belt 11 stops at a position determined in the below-described "belt stop position determination processing upon completion of an image forming job".

A cleaning blade 14 is provided in the vicinity of the driven roller 13. The cleaning blade 14 is in contact with the intermediate transfer belt 11, and cleans and removes residual toner on the intermediate transfer belt 11 after a full color toner image is secondary-transferred onto a recording sheet.

The exposure unit 10 includes a light emitting element, such as a laser diode. Upon receiving a drive signal from the controller 60, the exposure unit 10 emits a laser beam L for forming Y, M; C and K color images, and exposure-scans the photosensitive drums of the imaging units 3Y, 3M, 3C, and 3K.

By the exposure-scanning, an electrostatic latent image is formed on the photosensitive drum 31Y which has been charged by the charger 32Y. Similarly, an electrostatic latent image is formed on each of the photosensitive drums of the imaging units 3M, 3C, and 3K. The electrostatic latent images on the photosensitive drums are developed by the developers of the imaging units 3Y, 3M, 3C, and 3K, whereby toner images corresponding to the respective photosensitive drums are formed.

With the primary transfer rollers of the imaging units 3Y, 3M, 3C, and 3K (in FIG. 1, only the primary transfer roller of the imaging unit 3Y is indicated by the reference sign 34Y, and the reference signs of the other primary transfer rollers are omitted), the toner images thus formed are sequentially primary-transferred onto the intermediate transfer belt 11 at different timings in a manner that the toner images are layered on the same position on the intermediate transfer belt 11. Thereafter, the toner images on the intermediate transfer belt 11 are collectively secondary-transferred onto a recording sheet by the electrostatic force applied by the secondary transfer roller 45.

The recording sheet onto which the toner images have been secondary-transferred is further conveyed to the fixing device 5. The toner images (unfixed images) on the recording sheet are thermally fixed onto the recording sheet with heat and pressure applied by the fixing device 5. Thereafter, the recording sheet having the toner images fixed thereon is ejected onto an ejection tray 72 by an ejection roller 71.

The paper feeder 4 includes a paper feed cassette 41, a feed roller 42, a timing roller 44, and so on. The paper feed cassette 41 contains recording sheets (shown by a reference sign S in FIG. 1). The feed roller 42 feeds the recording sheets in the paper feed cassette 41, one at a time, to a conveyance path 43. The timing roller 44 sends the fed recording sheets one-by-one to a secondary transfer position 46 at the timing when the toner images on the intermediate transfer belt 11 are transferred to the secondary transfer position 46. Note that the number of paper feed cassettes is not limited to one, and may be two or more.

The recording sheets may come in different sizes and thicknesses (plain paper, thick paper, etc.) or may be film sheets such as OHP sheets. In a case where there are more than one paper feed cassette, each of the recording sheets in different sizes, different thicknesses, or different materials may be appropriately stored in a corresponding paper feed cassette.

Each roller, such as the feed roller 42 and the timing roller 44, is driven to rotate by a conveyance motor (not shown) as a power source. The drive force by the conveyance motor is transmitted via a power transmission mechanism (not shown) such as a gear or a belt. The conveyance motor may be, for example, a stepping motor which can control the rotational speed of rollers with a high degree of accuracy.

A recording sheet is conveyed from the paper feeder 4 to the secondary transfer position 46, at the timing when the toner images on the intermediate transfer belt 11 are transferred to the secondary transfer position 46. Subsequently, the toner images on the intermediate transfer belt 11 are collectively secondary-transferred onto the recording sheet by the secondary transfer roller 45.

The fixing device 5 is composed of a heating roller, a pressure roller, etc., and is arranged near the secondary transfer position 46. The fixing device 5 thermally fixes the toner images on the recording sheet which have been secondary-transferred.

[3] STRUCTURE OF CONTROLLER

Figure 2:
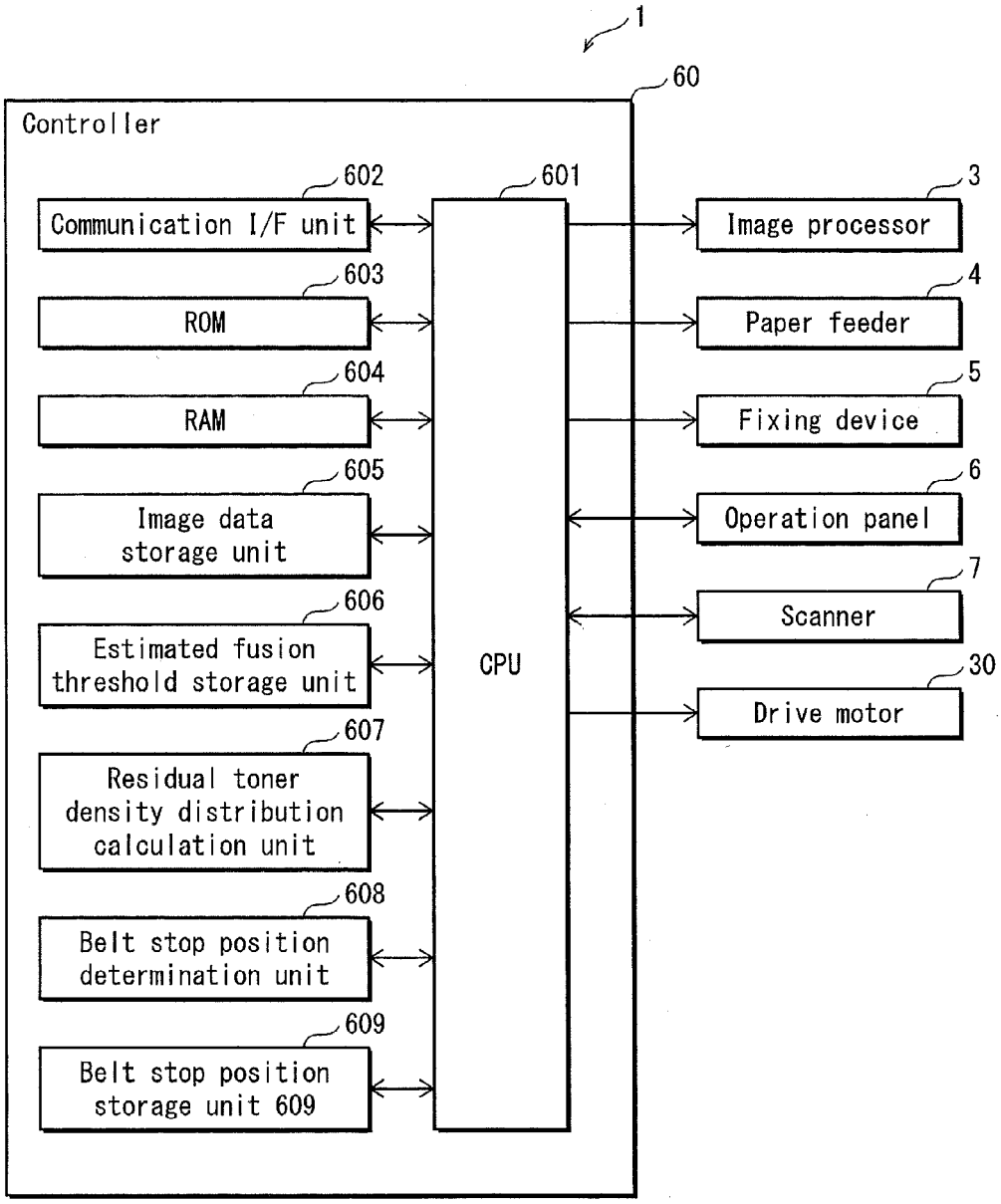
FIG. 2 shows the relationship between the components of a controller 60 and main components subjected to control by the controller 60.

FIG. 2 shows the relationship between the components of the controller 60 and main components subjected to control by the controller 60. The controller 60 is a so-called computer. As shown in FIG. 2, the controller 60 includes: a CPU (Central Processing Unit) 601; a communication interface (I/F) unit 602; a ROM (Read Only Memory) 603; a RAM (Random Access Memory) 604; an image data storage unit 605; an estimated fusion threshold storage unit 606; a residual toner density distribution calculation unit 607; a belt stop position determination unit 608; a belt stop position storage unit 609; and so on.

The communication I/F unit 602 is an interface to establish connection with a LAN such as a LAN card or a LAN board. The ROM 603 stores therein programs, such as a program for controlling the image processor 3, the paper feeder 4, the fixing device 5, the operation panel 6, a scanner 7, and a drive motor 30, and a program for performing belt stop position control processing which is described below.

The RAM 604 is used as a work area for the CPU 601 at the time of execution of a program.

The image data storage unit 605 stores therein image data for forming images. The image data is input to the image data storage unit 605 via the communication I/F unit 602 or the scanner 7. The CPU 601 executes various programs stored in the ROM 603, and thereby controls the image processor 3, the paper feeder 4, the fixing device 5, the operation panel 6, the scanner 7, the drive motor 30, and so on, and further performs the belt stop position control processing which is described below.

The estimated fusion threshold storage unit 606 stores therein an estimated threshold density of the residual toner in a section (hereinafter, "non-cleaning section") from the secondary transfer position 46 to immediately before a toner cleaning position at which the residual toner is cleaned by the cleaning blade 14. Note that the "toner cleaning position" is a position at which cleaning of the residual toner by the cleaning blade 14 is completed. Also, the "estimated threshold density" indicates a residual toner density, above which fused toner is highly likely to remain on the intermediate transfer belt 11 even after the cleaning by the cleaning blade 14. Specifically, it is a residual toner density above which, if the residual toner is left uncleaned within the non-cleaning section, the amount of residual toner fused onto the intermediate transfer belt by the heat generated from the fixing device 5 exceeds the amount of fused toner removable by the cleaning blade 14. The estimated threshold density differs depending on a position within the non-cleaning section.

The reason why the value of the estimated threshold density differs is because the amount of residual toner to be fused increases in proportion to an increase in temperature, and accordingly, the value of the estimated threshold density becomes smaller. In the present embodiment, the fixing device 5 is arranged near the secondary transfer position 46. Therefore, the value of the estimated threshold density becomes higher with increasing distance from the secondary transfer position 46 (i.e., toward the cleaning position). Note that the tendency in the variation in the value of the estimated threshold density differs depending on the position at which the fixing device is arranged.

The estimated fusion threshold storage unit 606 stores therein an estimated threshold density at an arbitrary position within the non-cleaning section. Specifically, the estimated fusion threshold storage unit 606 stores therein a relational expression indicating a relationship between each position within the non-cleaning section and the estimated threshold density at the position.

Also, instead of the relational expression, the estimated fusion threshold storage unit 606 may store therein a table indicating a correspondence between each area within the non-cleaning section and the estimated threshold density in the area. Each area is obtained by dividing the non-cleaning section at predetermined intervals (e.g., into 20 areas).

Note that the relational expression described above may be calculated based on the following experiment, for example. First, in the printer 1, toner is placed on different positions on the intermediate transfer belt 11 within the non-cleaning section. In this state, the toner is left for a predetermined time period (e.g., two hours). During this period, the fixing device 5 is in operation. After the predetermined time period elapses, the toner on the intermediate transfer belt 11 is cleaned by the cleaning blade 14. After the cleaning, whether fused toner remains at each position on the intermediate transfer belt 11 is observed. This experiment is repeatedly conducted by changing the density of the toner to be left at each position on the intermediate transfer belt 11. Then, at each position, the maximum of the toner density at which fused toner does not remain (or the amount of fused toner remaining on the belt is extremely small) is obtained as an estimated threshold density. Finally, based on a correspondence between each position and the estimated threshold density at the position thus obtained, the relational expression is calculated. By conducting this experiment, it is also possible to create the aforementioned table.

Upon receiving image data via the communication I/F unit 602 or the scanner 7, the residual toner density distribution calculation unit 607 (i) calculates, for each area corresponding to the width of a predetermined number of pixels of the image data (hereinafter, "predetermined pixel area") in a sub-scanning direction (i.e., direction perpendicular to a conveyance direction of the intermediate transfer belt 11), the total number of pixels in the scanning direction which is obtained by summing up the number of pixels of Y, M, C and K color image data pieces in the scanning direction, (ii) obtains an estimated toner density ($g/m^2$) in the area (i.e., predetermined pixel area), and (iii) multiplies the estimated toner density by a predetermined residual toner rate determined in an experiment. In this way, the residual toner density distribution calculation unit 607 calculates, for each image data piece, the estimated density of the residual toner in each predetermined pixel area.

Here, the residual toner rate is calculated with use of the formula below.

$$\text{(Residual toner rate)}=1-\text{(Primary transfer rate of toner image)}\times\text{(Secondary transfer rate of toner image)}$$

Accordingly, in printer 1, the "primary transfer rate of toner image" and "secondary transfer rate of toner image" are calculated in advance during the experiment so as to calculate the residual toner rate. For example, provided that the primary transfer rate is 0.95 and the secondary transfer rate is 0.90, the residual toner rate is 0.145 according to the aforementioned formula.

The belt stop position determination unit 608 determines the stop position of the intermediate transfer belt 11, which is a position at which the intermediate transfer belt 11 stops upon completion of an image forming job, based on (i) the density of the residual toner in each predetermined pixel area which is calculated by the residual toner density distribution calculation unit 607 and (ii) the estimated threshold density of the residual toner at an arbitrary position within the non-cleaning section which is stored in the estimated fusion threshold storage unit 606.

Specifically, the belt stop position determination unit 608 determines the stop position as follows. The belt stop position determination unit 608 obtains, as the distribution information, a result of calculation from the residual toner density distribution calculation unit 607, the result of calculation being of the density of the residual toner in each predetermined pixel area remaining at each position within the non-cleaning section on the intermediate transfer belt 11 before cleaning, when a toner image on the last page is transferred onto a recording sheet at an image forming job.

Subsequently, the belt stop position determination unit 608 makes the following determination in the belt stop position control processing described below, before the residual toner in the predetermined pixel area remaining at the secondary transfer position 46 at the end of the image forming job (hereinafter, "last residual toner") reaches the cleaning position. Specifically, the belt stop position determination unit 608 determines whether there is a position at which the density of the residual toner in the predetermined pixel area at each position within the non-cleaning section, excluding the cleaning position, is equal to or below the corresponding estimated threshold density.

If such a position exists, the belt stop position determination unit 608 determines the position as the stop position of the last residual toner described above. If such a position does not exist, the belt stop position determination unit 608 determines the cleaning position as the stop position of the last residual toner described above.

Figure 3:
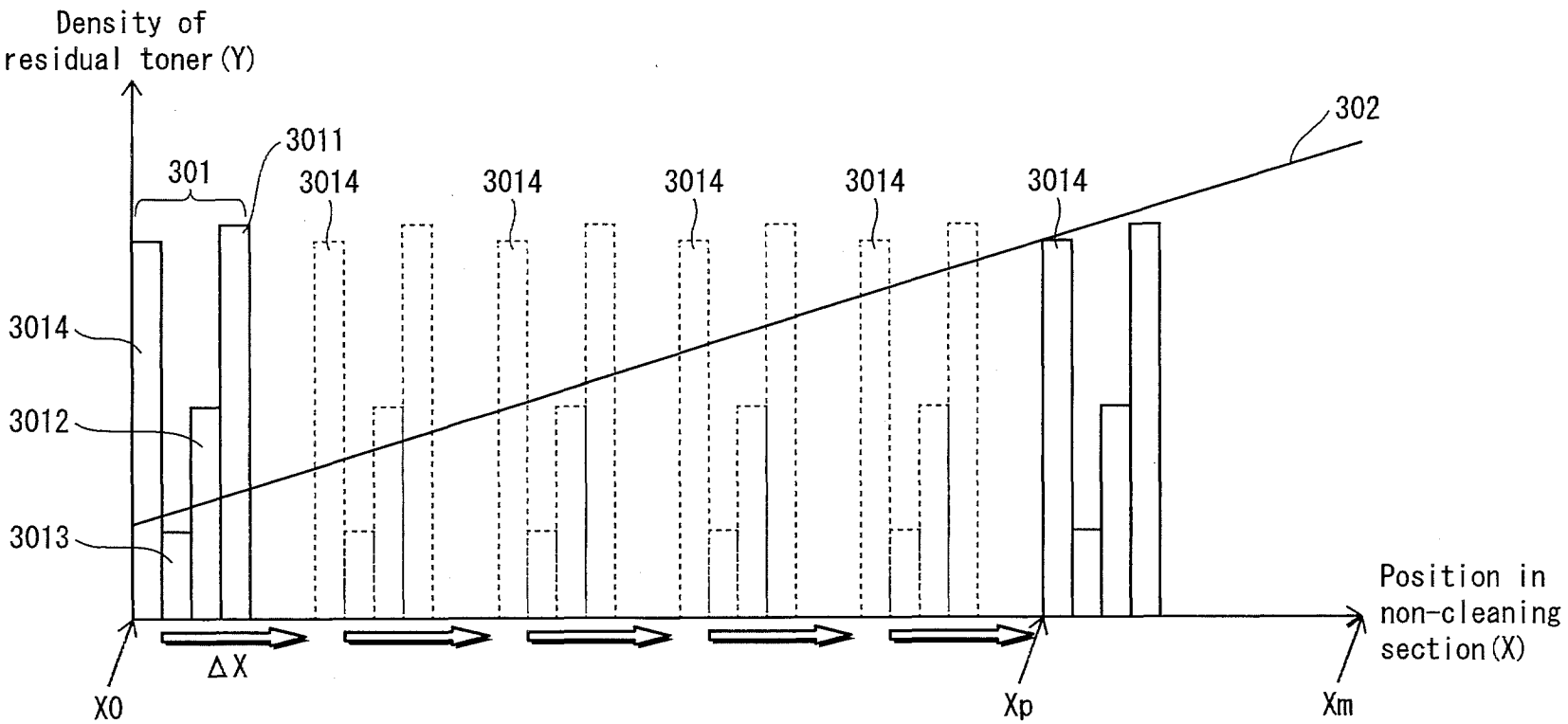
FIG. 3 shows an image of a processing flow where a belt stop position determination unit 608 determines a stop position of an intermediate transfer belt 11.

FIG. 3 shows an image of the flow of the processing by the belt stop position determination unit 608. In FIG. 3, the vertical axis (Y coordinate) represents a density of residual toner, and the horizontal axis (X coordinate) represents a position within the non-cleaning section (X0 denotes the "secondary transfer position 46", and Xm indicates the "cleaning position"). As shown in FIG. 3, residual toner 301 corresponding to image data of one page remains within the non-cleaning section. The residual toner 301 includes residual toner in four predetermined pixel areas, i.e., predetermined pixel areas 3011 to 3014.

Also, the reference sign 302 in FIG. 3 indicates a graph of the relational expression stored in the estimated fusion threshold storage unit 606, and the graph shows the estimated threshold density of the residual toner at each position within the non-cleaning section. The residual toner 301 is sequentially moved to the direction of the hollow arrows (i.e., direction toward the cleaning position Xm), namely, the X coordinate value of each predetermined pixel area is incremented by ΔX. Then, when the X coordinate value of the last residual toner (i.e., the residual toner in the predetermined pixel area 3014) reaches Xp ($X0<Xp<Xm$), the density of the residual toner in each predetermined pixel area becomes equal to or below the corresponding estimated threshold density.

Before the last residual toner (i.e., the residual toner in the predetermined pixel area 3014) reaches Xp, the belt stop position determination unit 608 compares (i) the density of the residual toner in the predetermined pixel area at each position indicated by the obtained distribution information with (ii) the corresponding estimated threshold density, and thereby determines whether the density of residual toner in the predetermined pixel area at each position has become equal to or below the corresponding estimated threshold density. Based on this determination, the belt stop position determination unit 608 specifies the position Xp at which the density of residual toner in each predetermined pixel area becomes equal to or below the corresponding estimated threshold density, and determines the position Xp to be the stop position of the last residual toner (i.e., the residual toner in the predetermined pixel area 3014).

Referring back to FIG. 2, the belt stop position storage unit 609 stores therein the stop position determined by the belt stop position determination unit 608. The operation panel 6 includes a liquid crystal display, a touch panel mounted on the liquid crystal display, operation buttons with which the user inputs various instructions, and such. The operation panel 6 receives inputs of various instructions from user operations via the touch panel and the operation buttons. The liquid crystal display shows an operation screen such as print setup screen, and various types of display information such as a result of printing.

The scanner 7 reads an image, generates image data from the image, and outputs the image data to the controller 60. The drive motor 30 drives the driving roller 12 to rotate, thereby causing the intermediate transfer belt 11 to rotate and convey the residual toner on the intermediate transfer belt 11.

[4] BELT STOP POSITION CONTROL PROCESSING

Figure 4:
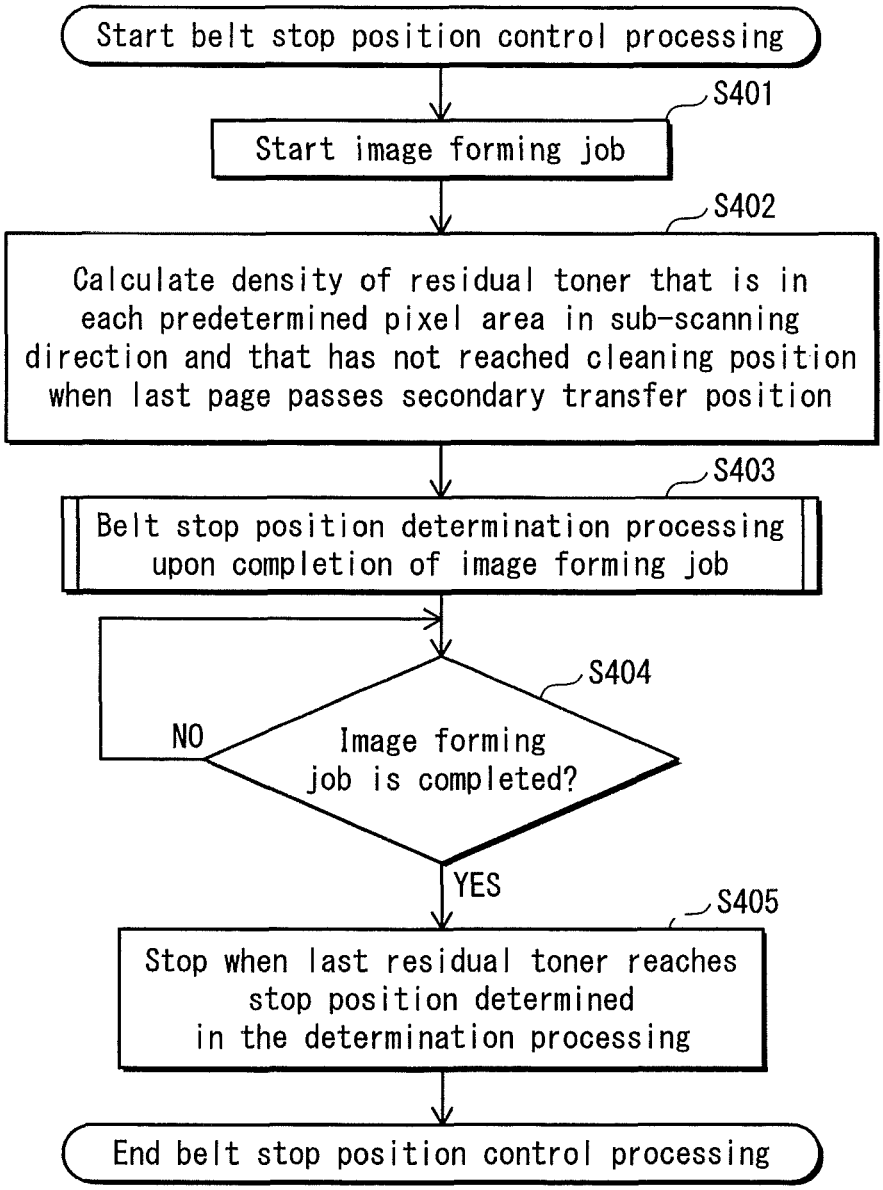
FIG. 4 is a flowchart showing belt stop position control processing performed by the controller 60.

FIG. 4 is a flowchart showing the belt stop position control processing performed by the controller 60. Upon receiving an instruction for starting an image forming job from the user via the operation panel 6 or the communication I/F unit 602, the controller 60 starts the image forming job (step S401). The controller 60 calculates, for each of image data pieces corresponding to images which have not reached the cleaning position of the cleaner blade 14 (in the present embodiment, it is assumed that the image data pieces are of the last three pages) when an image corresponding to an image data piece of the last page among image data pieces pertaining to the image forming job stored in the image data storage unit 605 passes the secondary transfer position 46, the density of the residual toner in each predetermined pixel area within the non-cleaning section in the sub-scanning direction, and obtains the density of the residual toner thus calculated as the distribution information (step S402). Then, the controller 60 performs "belt stop position determination processing upon completion of an image forming job" which is described below (step S403).

When the image forming job is completed (step S404: YES), the controller 60 controls the drive of the drive motor 30, moves the last residual toner to the stop position determined in step S403, and stops the drive of the drive motor 30 when the last residual toner reaches the stop position (step S405).

Here, the controller 60 may control the stop position of the last residual toner as follows. The controller 60 measures the length of time that has elapsed since completion of exposure scanning of a photosensitive drum. Then, the controller 60 divides the distance from the exposure position to the primary transfer position by the rotation speed of the photosensitive drum, thereby calculating a transfer timing at which the last part of the toner image on the photosensitive drum, which corresponds to the last residual toner, is primary-transferred onto the intermediate transfer belt 11. Based on the product of (i) the length of time that has elapsed since the transfer timing and (ii) the travel speed of the intermediate transfer belt 11, the controller 60 calculates the travel distance of the last part of the toner image from the primary transfer position. Then, the controller 60 regards the travel distance as the travel distance of the last residual toner from the primary transfer position, and controls the stop position of the last residual toner.

In the case of forming a color image, the controller 60 calculates, for each photosensitive drum of a respective color, the transfer timing at which the last part of the toner image on the photosensitive drum, which corresponds to the last residual toner, is primary-transferred onto the intermediate transfer belt 11. Among the transfer timings thus calculated, the controller 60 uses, for the calculation of the travel distance of the last residual toner from the primary transfer position, the transfer timing corresponding to the photosensitive drum for a toner color which is transferred at the most downstream position in the traveling direction of the intermediate transfer belt 11 (the photosensitive drum of the imaging unit 3K in the present embodiment). In this way, the controller 60 controls the stop position of the last residual toner.

Alternatively, the controller 60 may control the stop position of the last residual toner in the following manner. That is, a sheet sensor is provided in the conveyance path 43 of recording sheets. Then, based on the time at which the rear end of the last recording sheet in one image forming job is detected, the controller 60 calculates the timing at which the rear end of the last recording sheet passes the secondary transfer position 46. On the intermediate transfer belt 11, a position with which the rear end of the last recording sheet is in contact when the rear end thereof passes the secondary transfer position 46 is regarded as the position of the last residual toner (i.e., the position of the rear end of the recording sheet is regarded as being substantially equal to the position of the last residual toner). Then, based on the product of (i) the length of time that has elapsed since the rear end of the last recording sheet passed the secondary transfer position 46 and (ii) the travel speed of the intermediate transfer belt 11, the controller 60 calculates the travel distance of the intermediate transfer belt 11. Then, with the travel distance being regarded as a distance that the last residual toner travels from the secondary transfer position 46, the controller controls the stop position of the last residual toner.

Figure 5:
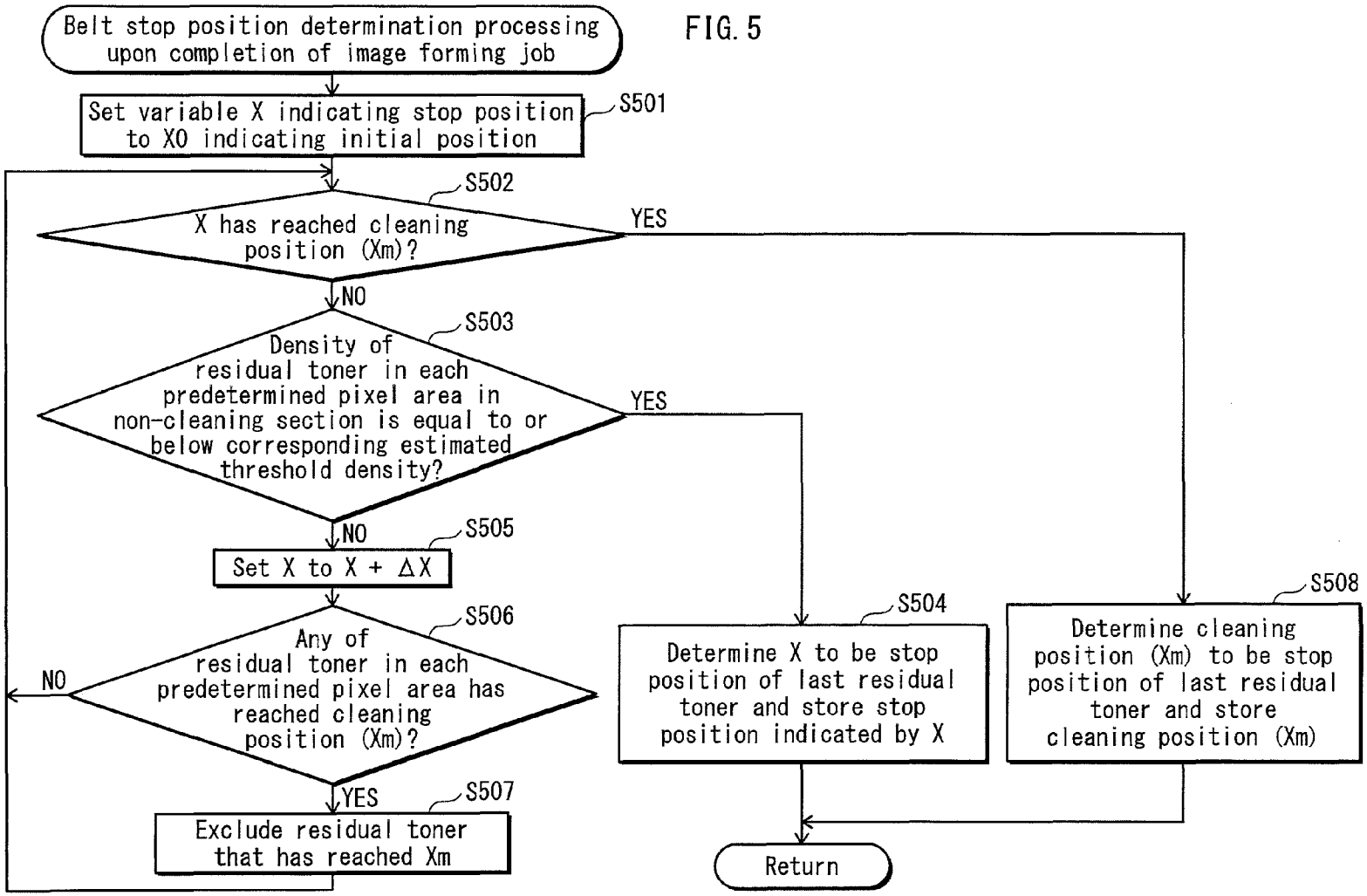
FIG. 5 is a flowchart showing belt stop position determination processing performed by the controller 60 upon completion of an image forming job.

Next, a description is provided of operations during belt stop position determination processing performed upon completion of the image forming job in step S403. FIG. 5 is a flowchart showing the operation during the belt stop position determination processing in step S403 onwards. The controller 60 sets a variable X, which indicates the stop position of the last residual toner in the sub-scanning direction, to a value X0, which indicates an initial position, i.e., the secondary transfer position 46 (step S501). Then, the controller 60 determines whether the variable X has reached the cleaning position (Xm) (step S502).

When determining negatively in step S502 (step S502: NO), the controller 60 determines, based on the distribution information obtained in step S402, whether the residual toner in each predetermined pixel area remaining at each position within the non-cleaning section is equal to or below the corresponding estimated threshold density when the last residual toner reaches the stop position indicated by the variable X (step S503). When determining affirmatively (step S503: YES), the controller 60 determines the stop position indicated by the variable X as the stop position of the last residual toner, and stores the stop position thus determined into the belt stop position storage unit 609 (step S504).

When determining negatively (step S503: NO), the controller 60 sets the value of the variable X to a value obtained by adding, to the value of the variable X, a predetermined value (ΔX, which is, for example, a value corresponding to a distance obtained by dividing the distance of the non-cleaning section by 20), and thereby moving the stop position of the last residual toner toward the downstream end by ΔX (step S505). Along with the movement of the stop position, the controller 60 determines whether any of the residual toner in each predetermined pixel area in the sub-scanning direction, excluding the last residual toner, has reached the cleaning position (Xm) (step S506).

When determining affirmatively (step S506: YES), the controller 60 excludes the residual toner that has reached the cleaning position (Xm) from the residual toner subjected to the determination in step S503 (step S507), and thereafter moves to the processing of step S502. When determining negatively (step S506: NO), the controller 60 directly moves to the processing of step S502.

Also, when determining affirmatively in step S502 (step S502: YES), the controller 60 determines the cleaning position as the stop position of the last residual toner, and stores the stop position thus determined into the belt stop position storage unit 609 (step S508).

Figure 6:
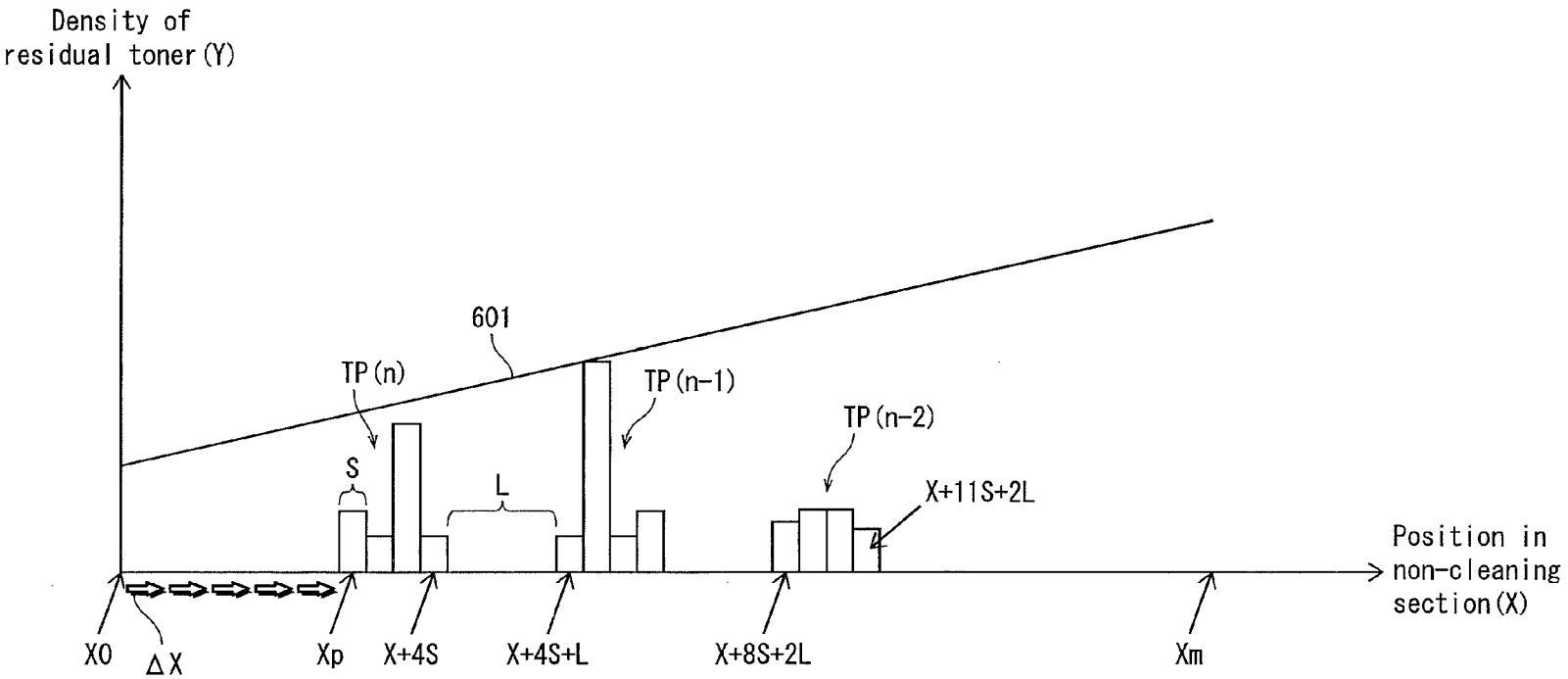
FIG. 6 shows an image of an example of a correspondence between (i) the position of residual toner in each predetermined pixel area within the non-cleaning section in the sub-scanning direction, (ii) the density of the residual toner in the predetermined pixel area, and (iii) the estimated threshold density at the position of the residual toner in the predetermined pixel area, when the residual toner in the predetermined pixel area remaining at the secondary transfer position at the end of an image forming job is moved toward the downstream end of the non-cleaning section by ΔX according to the flowchart of FIG. 5.

FIG. 6 shows an image of an example of a correspondence between (i) the position of residual toner in each predetermined pixel area within the non-cleaning section in the sub-scanning direction, (ii) the density of the residual toner in the predetermined pixel area, and (iii) the estimated threshold density at the position of the residual toner in the predetermined pixel area, when the last residual toner is moved toward the downstream end of the non-cleaning section by ΔX according to the flowchart of FIG. 5.

In FIG. 6, each hollow arrow indicates a per-travel distance ΔX traveled by the last residual toner each time. The reference sign S indicates the width of a predetermined pixel area in the sub-scanning direction. The reference sign TP (n) indicates residual toner corresponding to image data of the last page. The reference sign TP (n−1) indicates residual toner corresponding to image data of a page that is one page before the last page. The reference sign TP (n−2) indicates residual toner corresponding to image data of a page that is two pages before the last page. The residual toner corresponding to the image data of each page includes residual toner in each of four predetermined pixel areas shown by rectangles. The height of each rectangle indicates the density of residual toner in the corresponding predetermined pixel area.

Also, the reference sign 601 is a graphic representation of the relational expression stored in the estimated fusion threshold storage unit 606, and indicates the estimated threshold density of the residual toner at each position within the non-cleaning section.

The reference sign L indicates a gap between the residual toner corresponding to one page and the residual toner corresponding to another page. The gap is substantially equal to the gap between page images primary-transferred onto the intermediate transfer belt 11. Also, in FIG. 6, the vertical axis (Y coordinate) represents a density of residual toner, and the horizontal axis (X coordinate) represents a position within the non-cleaning section. The reference sign X0 denotes the "secondary transfer position 46", the reference sign Xp indicates the current position of the last residual toner, and Xm indicates the "cleaning position". The values S and L are known values settable by the manufacturer of the printer 1. Therefore, when a position of the last residual toner in the X coordinate is determined, the position of the residual toner in each of the remaining predetermined pixel areas in the X coordinate is also determined.

For example, suppose that the position of the last residual toner (i.e., residual toner in the predetermined pixel area closest to the secondary transfer position X0 among the predetermined pixel areas of TP (n) in FIG. 6) in the X coordinate is Xp, as shown in FIG. 6. In this case, it is determined that the position of residual toner in the predetermined pixel area farthest from the secondary transfer position X0 among the predetermined pixel areas of TP (n) in the X coordinate is (X+4S); the position of residual toner in the predetermined pixel area closest to the secondary transfer position X0 among the predetermined pixel areas of TP (n−1) in the X coordinate is (X+4S+L); the position of residual toner in the predetermined pixel area closest to the secondary transfer position X0 among the predetermined pixel areas of TP (n−2) in the X coordinate is (X+8S+2L); and the position of residual toner in the predetermined pixel area farthest from the secondary transfer position X0 among the predetermined pixel areas of TP (n−2) in the X coordinate is (X+11S+2L).

In FIG. 6, the movement of the last residual toner (i.e., residual toner in the predetermined pixel area closest to the secondary transfer position X0 among the predetermined pixel areas of TP (n)) by ΔX toward the cleaning position is repeated a plurality of times (five times in this example), whereby the last residual toner (i.e., residual toner in the predetermined pixel area closest to the secondary transfer position X0 among the predetermined pixel areas of TP (n)) reaches the position Xp within the non-cleaning section. In this state, the density of the residual toner remaining in each predetermined pixel area of TP (n−2), TP (n−1), and TP (n) becomes equal to or below the corresponding estimated threshold density, which is at a position in the graph 601 corresponding to the position of the residual toner in each predetermined pixel area (i.e., a position, in the graph 601, having the same X coordinate as the position of the residual toner in each predetermined pixel area). Accordingly, in the example shown in FIG. 6, the controller 60 determines the position Xp as the stop position of the last residual toner (i.e., residual toner in the predetermined pixel area closest to the secondary transfer position X0 among the predetermined pixel areas of TP (n)).

Figure 7:
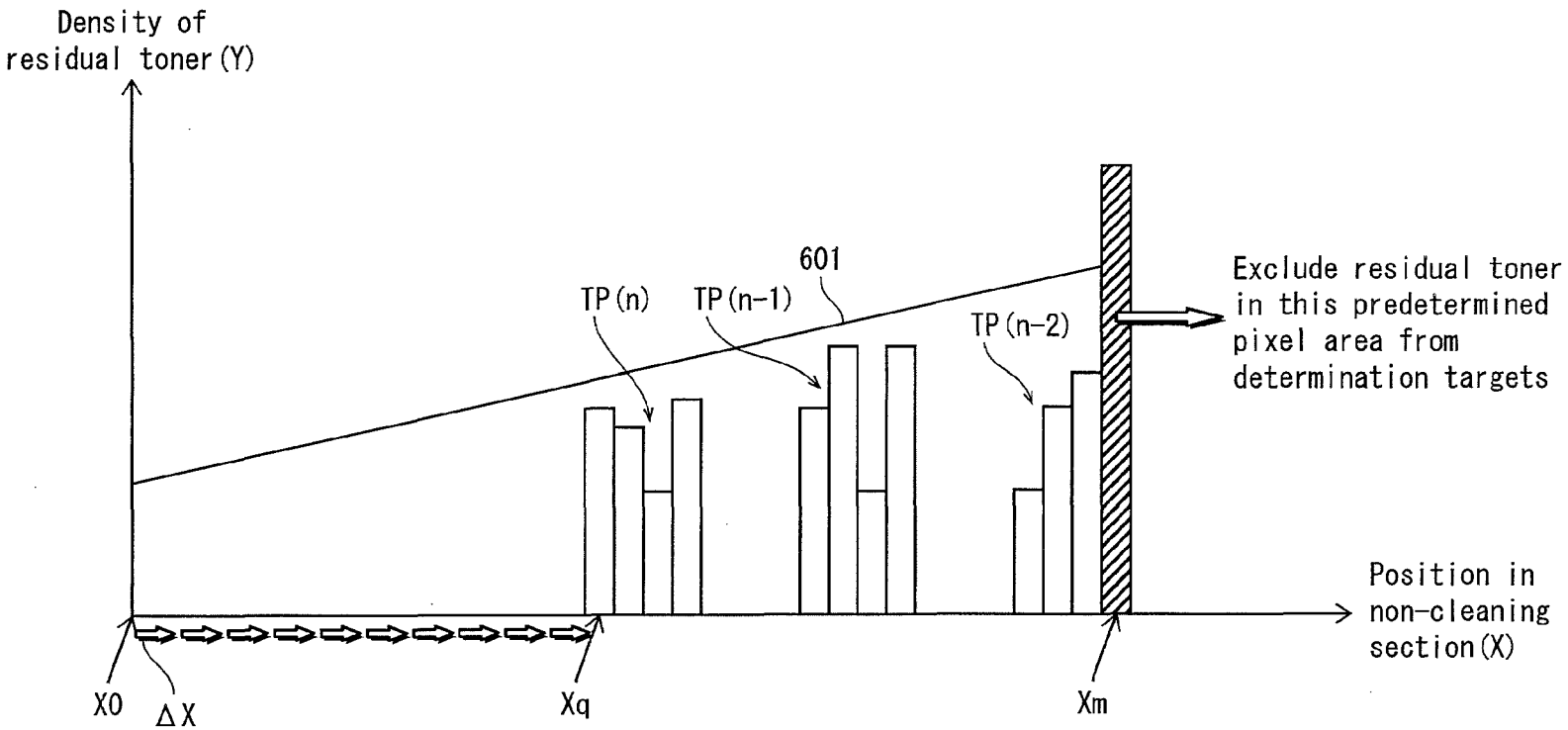
FIG. 7 relates to residual toner having a different toner density pattern from that in FIG. 6, and shows an image of a correspondence between (i) the position of residual toner in each predetermined pixel area within the non-cleaning section in the sub-scanning direction, (ii) the density of the residual toner in the predetermined pixel area, and (iii) the estimated threshold density at the position of the residual toner in the predetermined pixel area, when the residual toner in the predetermined pixel area remaining at the secondary transfer position at the end of an image forming job is moved toward the downstream end of the non-cleaning section by ΔX according to the flowchart of FIG. 5.

FIG. 7 relates to residual toner having a different toner density pattern from that in FIG. 6, and shows an image of a correspondence between (i) the position of residual toner in each predetermined pixel area within the non-cleaning section in the sub-scanning direction, (ii) the density of the residual toner in the predetermined pixel area, and (iii) the estimated threshold density at the position of the residual toner in the predetermined pixel area, when the last residual toner is moved toward the downstream end of the non-cleaning section by ΔX according to the flowchart of FIG. 5.

Regarding FIG. 7, the same structural elements as those already described in FIG. 6 are denoted by the same reference signs and no further description is given here. In FIG. 7, the movement of the last residual toner (i.e., residual toner in the predetermined pixel area closest to the secondary transfer position X0 among the predetermined pixel areas of TP (n)) by ΔX toward the cleaning position is repeated a plurality of times (ten times in this example), whereby the last residual toner reaches the position Xq within the non-cleaning section. Accordingly, residual toner in the predetermined pixel area farthest from the secondary transfer position X0 among the predetermined pixel areas of TP (n−2) (i.e., the residual toner shown by the hatched rectangle) reaches the cleaning position (Xm). The density of residual toner in the predetermined pixel area farthest from the secondary transfer position X0 among the predetermined pixel areas of TP (n−2) (hereinafter, "first residual toner") exceeds the estimated threshold density at the position corresponding to the cleaning position (Xm) in the example of FIG. 7. However, the controller 60 excludes the first residual toner from the determination targets in step S503 in the flowchart of FIG. 5. This is because of the following reason. That is, the first residual toner exceeds each estimated threshold density within the non-cleaning section (step S503: NO). However, the first residual toner is positioned closer to the cleaning position than the last residual toner, and therefore the first residual toner reaches the cleaning position (step S506: YES) before the last residual toner reaches the cleaning position (step S502: NO). For this reason, if the first residual toner reaches the cleaning position (Xm) and exceeds the corresponding estimated threshold density, the first residual toner is excluded from the determination targets in step S503. After the first residual toner is excluded, the density of the residual toner in each predetermined pixel area of TP (n−2), TP (n−1), and TP (n) becomes equal to or below the corresponding estimated threshold density, which is at a position in the graph 601 corresponding to the position of the residual toner in each predetermined pixel area (i.e., a position, in the graph 601, having the same X coordinate as the position of the residual toner in each predetermined pixel area). Therefore, the controller 60 determines the position Xq as the stop position of the last residual toner (i.e., residual toner in the predetermined pixel area closest to the secondary transfer position X0 among the predetermined pixel areas of TP (n)).

Figure 8:
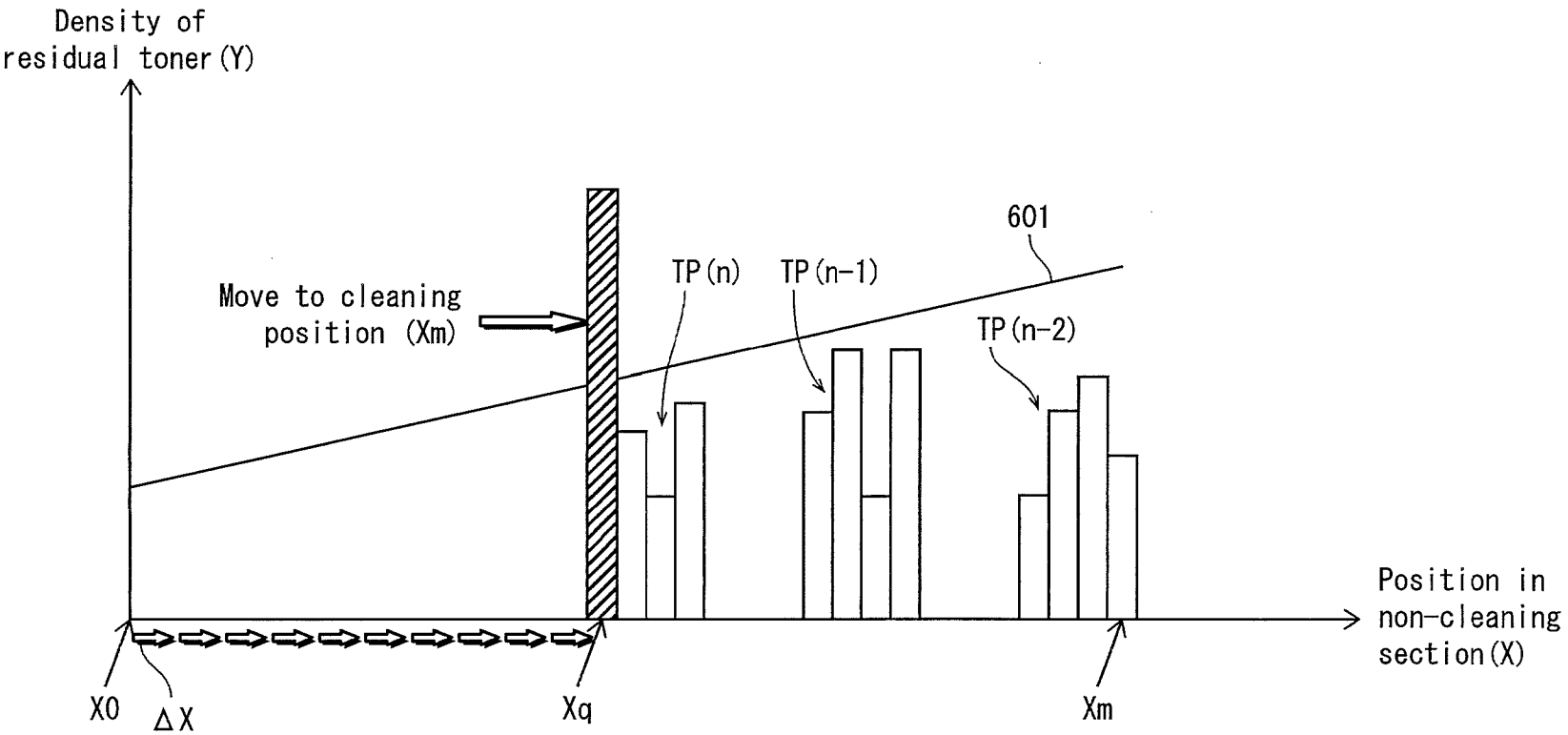
FIG. 8 relates to residual toner having a different toner density pattern from those in FIGS. 6 and 7, and shows an image of a correspondence between (i) the position of residual toner in each predetermined pixel area within the non-cleaning section in the sub-scanning direction, (ii) the density of the residual toner in the predetermined pixel area, and (iii) the estimated threshold density at the position of the residual toner in the predetermined pixel area, when the residual toner in the predetermined pixel area remaining at the secondary transfer position at the end of an image forming job is moved toward the downstream end of the non-cleaning section by ΔX according to the flowchart of FIG. 5.

FIG. 8 relates to residual toner having a different toner density pattern from those in FIGS. 6 and 7, and shows an image of a correspondence between (i) the position of residual toner in each predetermined pixel area within the non-cleaning section in the sub-scanning direction, (ii) the density of the residual toner in the predetermined pixel area, and (iii) the estimated threshold density at the position of the residual toner in the predetermined pixel area, when the last residual toner is moved toward the downstream end of the non-cleaning section by ΔX according to the flowchart of FIG. 5.

Regarding FIG. 8, the same structural elements as those already described in FIG. 6 are denoted by the same reference signs and no further description is given here. In FIG. 8, the density of the last residual toner (i.e., residual toner in the predetermined pixel area closest to the secondary transfer position X0 among the predetermined pixel areas of TP (n)) (shown by the hatched rectangle) exceeds the estimated threshold density at the position corresponding to the cleaning position (Xm) (i.e., exceeds each estimated threshold density within the non-cleaning section). Therefore, until the last residual toner reaches the cleaning position, the density of the residual toner in each of the predetermined pixel areas of TP (n−2), TP (n−1), and TP (n) does not become equal to or below the corresponding estimated threshold density, which is at a position in the graph 601 corresponding to the position of the residual toner in each predetermined pixel area (i.e., a position, in the graph 601, having the same X coordinate as the position of the residual toner in each predetermined pixel area) (step S503: NO). Accordingly, the controller 60 determines the cleaning position as the stop position of the last residual toner (i.e., residual toner in the predetermined pixel area closest to the secondary transfer position X0 among the predetermined pixel areas of TP (n)) as shown in the flowchart of FIG. 5 (step S502: YES, step S508).

As described above, if there is a position at which the density of the residual toner in each predetermined pixel area remaining within the non-cleaning section is equal to or below the corresponding estimated threshold density before the last residual toner arrives at the cleaning position, then the drive of the intermediate transfer belt 11 is stopped before the last residual toner is moved to the cleaning position. This shortens the travel distance of the intermediate transfer belt 11. Consequently, it is possible to suppress the residual toner from being fused onto the intermediate transfer belt 11 by heat generated from the fixing device, to lengthen the life of the intermediate transfer belt 11, and to suppress power consumption.

(Modifications)

The present invention has been described above with reference to the embodiment. However, the present invention is not limited in this manner. The following modifications are also possible.

(1) In the belt stop position control processing of the present embodiment, the stop position of the intermediate transfer belt 11 is controlled upon completion of an image forming job. In this way, fusion of the residual toner onto the intermediate transfer belt 11 by heat generated from the fixing device is suppressed and the life of the intermediate transfer belt 11 is lengthened. However, the same processing may be performed on a photosensitive drum as an image carrier, instead of the intermediate transfer belt 11 as an image carrier.

This suppresses fusion of the residual toner onto the photosensitive drum by heat generated from the fixing device and lengthens the life of the photosensitive drum, in the same manner as in the intermediate transfer belt 11.

(2) In the belt stop position control processing in the present embodiment, the value of the estimated threshold density used for the belt stop position determination processing upon completion of an image forming job is changed depending on a position within the non-cleaning section. However, the belt stop position determination processing upon completion of an image forming job may be performed with use of the most strict estimated threshold density within the non-cleaning section (i.e., the estimated threshold density in the secondary transfer position 46), regardless of a position within the non-cleaning section. This also suppresses fusion of the residual toner onto the intermediate transfer belt 11 by heat generated from the fixing device and lengthens the life of the intermediate transfer belt 11, in the same manner as in the present embodiment. Also, the modification described in the item (2) may be applied to the modification described in the item (1).

(3) In the present embodiment, the estimated density of the residual toner in each predetermined pixel area is calculated based on the number of pixels in each predetermined pixel area of the corresponding image data. However, the estimated toner densities may be calculated with use of another method. For example, a toner density sensor may be provided at a predetermined position on each photoreceptor of a respective color, so as to directly measure the density of toner in each predetermined pixel area. Then, based on the measurement result, the estimated toner densities may be calculated. As the toner density sensor, it is possible, for example, to use an optical reflective sensor composed of light emitting element such as an LED and a light receiving element. Also, the modification described in the item (3) may be applied to the modifications described in the items (1) and (2).

(4) In the present embodiment, the estimated fusion threshold storage unit 606 stores therein only one relational expression indicating a relationship between (i) each position within the non-cleaning section and (ii) the estimated threshold density at the position. However, the estimated fusion threshold storage unit 606 may store therein a plurality of relational expressions depending on the environment in the printer 1 (e.g., temperature or/and humidity). Then, among the relational expressions, a relational expression corresponding to the environmental temperature or/and humidity in the printer 1 may be selected and used in the belt stop position determination processing upon completion of an image forming job. Also, the modification described in the item (4) may be applied to the modifications described in the items (1) to (3).

In this way, even if the environment in the printer 1 is changed during the belt stop position determination processing upon completion of an image forming job, the possibility of fusion of the residual toner within the non-cleaning section may be more accurately estimated with use of an estimated threshold density corresponding to the new environment after the change.

[5] CONCLUSION

One aspect of the present invention disclosed above is an image forming apparatus for transferring, at a transfer position, a toner image on an image carrier rotated by a drive unit onto a transfer medium, and thereafter thermally fixing the toner image to the transfer medium by a fixing device, the image forming apparatus comprising: a cleaner provided at a cleaning position on a rotation path of the image carrier, and configured to remove residual toner remaining on the image carrier; an acquisition unit configured to acquire distribution information, the distribution information relating to a distribution of a density of the residual toner remaining at each position within a section on the image carrier at an end of an image forming job, the section extending from the transfer position to immediately before the cleaning position; a determination unit configured to determine, based on the distribution information, whether or not the density of the residual toner remaining at least at the transfer position at the end of the image forming job exceeds a corresponding threshold density pertaining to occurrence of fusion of the residual toner; and a controller configured, if the determination unit determines negatively, to cause the drive unit to stop when the image forming job is completed and the residual toner remaining at the transfer position reaches a predetermined position within the section and, if the determination unit determines affirmatively, to cause the drive unit to stop when the image forming job is completed and the residual toner remaining at the transfer position reaches the cleaning position and is removed by the cleaner.

With the stated structure, when the density of the residual toner remaining at least at the transfer position at the end of the image forming job does not exceed a corresponding threshold density pertaining to occurrence of fusion of the residual toner, and fusion of the residual toner is less likely to occur, the rotation of the image carrier is stopped before residual toner remaining at the transfer position at the end of the image forming job reaches the cleaning position. This shortens the travel distance of the image carrier.

This makes it possible to suppress the residual toner from being fused onto the image carrier, and to lengthen the life of the image carrier. Also, since fusion of the residual toner onto the image carrier is suppressed without use of a cooling device such as a cooling fan or an exhaust fan, power consumption is suppressed as compared to the case where a cooling device is used.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. An image forming apparatus for transferring, at a transfer position, a toner image on an image carrier rotated by a drive unit onto a transfer medium, and thereafter thermally fixing the toner image to the transfer medium by a fixing device, the image forming apparatus comprising:

a cleaner provided at a cleaning position on a rotation path of the image carrier, and configured to remove residual toner remaining on the image carrier;

an acquisition unit configured to acquire distribution information, the distribution information relating to a distribution of a density of the residual toner remaining at each position within a section on the image carrier at an end of an image forming job, the section extending from the transfer position to immediately before the cleaning position;

a determination unit configured to determine, based on the distribution information, whether or not the density of the residual toner remaining at least at the transfer position at the end of the image forming job exceeds a corresponding threshold density pertaining to occurrence of fusion of the residual toner; and a controller configured, if the determination unit determines negatively, to cause the drive unit to stop when the image forming job is completed and the residual toner remaining at the transfer position reaches a predetermined position within the section and, if the determination unit determines affirmatively, to cause the drive unit to stop when the image forming job is completed and the residual toner remaining at the transfer position reaches the cleaning position and is removed by the cleaner.

2. The image forming apparatus of claim 1, wherein the predetermined position is a position at which, when the residual toner remaining at the transfer position reaches the position, the density of the residual toner remaining at each position on the image carrier within the section becomes equal to or below the corresponding threshold density.

3. The image forming apparatus of claim 1, wherein within the section, the threshold density is set to increase with increasing distance from the fixing device, and the determination by the determination unit is made by comparing the density of the residual toner remaining at each position on the image carrier within the section to the corresponding threshold density.

4. The image forming apparatus of claim 1, wherein the distribution information indicates a distribution of a density of a toner image at each position on the image carrier within the section, the toner image corresponding to the residual toner at each position on the image carrier within the section, and the determination unit includes a calculation unit configured to calculate the density of the residual toner at each position on the image carrier within the section, based on the distribution information.

5. The image forming apparatus of claim 1, wherein the image carrier is an intermediate transfer belt.

* * * * *